US007744330B2

(12) United States Patent
Haub et al.

(10) Patent No.: US 7,744,330 B2
(45) Date of Patent: Jun. 29, 2010

(54) CONTAINER PACKER SYSTEM AND METHOD

(75) Inventors: Gregory D. Haub, Douglas, OK (US); Chris D. Bartel, Fairview, OK (US)

(73) Assignee: Blue Tee Corporation, Enid, OK (US)

( * ) Notice: Subject to any disclaimer, the term of this patent is extended or adjusted under 35 U.S.C. 154(b) by 0 days.

(21) Appl. No.: 12/138,973

(22) Filed: Jun. 13, 2008

(65) Prior Publication Data

US 2009/0311085 A1 Dec. 17, 2009

(51) Int. Cl.
*B65B 69/00* (2006.01)

(52) U.S. Cl. ..... 414/416.03; 414/288

(58) Field of Classification Search ..... 414/400–402, 414/373, 395, 525.2, 390, 495, 403, 416.01, 414/416.03, 416.04

See application file for complete search history.

(56) References Cited

U.S. PATENT DOCUMENTS

| | | | | |
|---|---|---|---|---|
| 3,040,914 | A | 6/1962 | Johnson et al. | |
| 4,729,304 | A * | 3/1988 | Gardella et al. | 100/218 |
| 5,044,870 | A * | 9/1991 | Foster | 414/809 |
| 5,186,596 | A * | 2/1993 | Boucher et al. | 414/395 |
| 6,146,078 | A * | 11/2000 | Hamill et al. | 414/511 |
| 7,172,382 | B2 | 2/2007 | Frankel | |
| 7,275,906 | B1 * | 10/2007 | Pool | 414/395 |
| 2008/0038100 | A1 | 2/2008 | Frankel | |

FOREIGN PATENT DOCUMENTS

| | | |
|---|---|---|
| EP | 0655403 | 5/1995 |
| WO | WO-03080481 | 10/2003 |
| WO | WO-2006/044371 | 4/2006 |

OTHER PUBLICATIONS

"International Search Report", PCT/US2005/036512, Mar. 3, 2006, (Feb. 21, 2006).

* cited by examiner

*Primary Examiner*—Saúl J Rodriguez
*Assistant Examiner*—Joshua I Rudawitz
(74) *Attorney, Agent, or Firm*—Mark E. Brown

(57) ABSTRACT

A container packer system includes a transfer base, which receives a container packer adapted for movement longitudinally between retracted and extended positions with respect to the transfer base. The transfer base includes a power subsystem with a motor or engine driving an hydraulic pump for powering hydraulic piston-and-cylinder units of the system, including a container packer piston-and-cylinder unit for hydraulically extending and retracting the container packer. The container packer generally encloses an interior adapted for receiving bulk material for transfer to a transport container, which can comprise a standard shipping container, a trailer or some other bulk material receptacle. The container packer includes a push blade assembly longitudinally movably mounted in its interior and actuated by a push blade piston-and-cylinder unit. A container packer method includes the steps of loading the interior of the container packer with bulk material in its retracted position on the transfer base, locating a transport container in alignment and behind the transfer base, hydraulically inserting part of the container packer into the transport container, hydraulically emptying the container packer of bulk material into the transport container with the push blade assembly, retracting the push blade assembly within the container packer and extracting the container packer onto the transfer base.

5 Claims, 10 Drawing Sheets

CONTAINER PACKER SYSTEM AND METHOD

BACKGROUND OF THE INVENTION

1. Field of the Invention

The present invention relates generally to handling waste and other bulk materials, and in particular to a system and method for packing a container with bulk material for transport.

2. Description of the Related Art

Bulk materials of various types require transportation, e.g. from their sources to destinations for disposal or processing. Waste handling and other bulk material operations use a variety of transportation modes, including over-the-road trucks and marine vessels. Presently a large percentage of cargo is transported in standardized shipping containers, which are generally approximately 10'×10'×20' (width×height×length). Facilities are available for handling such containers, including loading and unloading to and from trailers, railcars and marine vessels. A bulk material operation would preferably utilize such standard containers and load or pack them as efficiently as possible in order to minimize the costs associated with procuring and transporting the containers and conveyance vehicles. Certain materials, such as scrap and refuse, are susceptible to compression packing in order to minimize space requirements and thereby increase efficiency.

The field of waste handling is a significant commercial activity, encompassing scrap disposal refuse hauling, materials recycling and demolition debris removal. Hazardous waste handling involves extra precautions and regulations. Improving bulk material handling and transporting equipment and procedures can significantly improve the efficiency, safety and effectiveness of waste handling operations. For example, common prior art waste handling methods involved loading large trash containers, bins and other receptacles using loaders, cranes and similar equipment.

Heretofore there has not been available a bulk material handling system or method with the advantages and features of the present invention, including a container packer for receiving the material and transferring it to a container or other vessel for transport.

SUMMARY OF THE INVENTION

In the practice of an aspect of the present invention, a container packer system is provided with a transfer base, which receives a container packer adapted for movement longitudinally between retracted and extended positions with respect to the transfer base. The transfer base includes a power subsystem with a motor or engine driving an hydraulic pump for powering hydraulic piston-and-cylinder units of the system, including a container packer piston-and-cylinder unit for hydraulically extending and retracting the container packer. The container packer generally encloses an interior adapted for receiving bulk material for transfer to a transport container, which can comprise a standard shipping container, a trailer or some other bulk material receptacle. The container packer includes a push blade assembly longitudinally movably mounted in its interior and actuated by a push blade piston-and-cylinder unit. In the practice of another aspect of the present invention, a container packer method includes the steps of loading the interior of the container packer with bulk material in its retracted position on the transfer base, locating a transport container in alignment and behind the transfer base, hydraulically inserting part of the container packer into the transport container, hydraulically emptying the container packer of bulk material into the transport container with the push blade assembly, retracting the push blade assembly within the container packer and extracting the container packer onto the transfer base.

BRIEF DESCRIPTION OF THE DRAWINGS

The drawings constitute a part of this specification and include exemplary embodiments and aspects of the present invention and illustrate various objects and features thereof.

DETAILED DESCRIPTION OF THE PREFERRED EMBODIMENTS

I. Introduction and Environment

Figure 1:
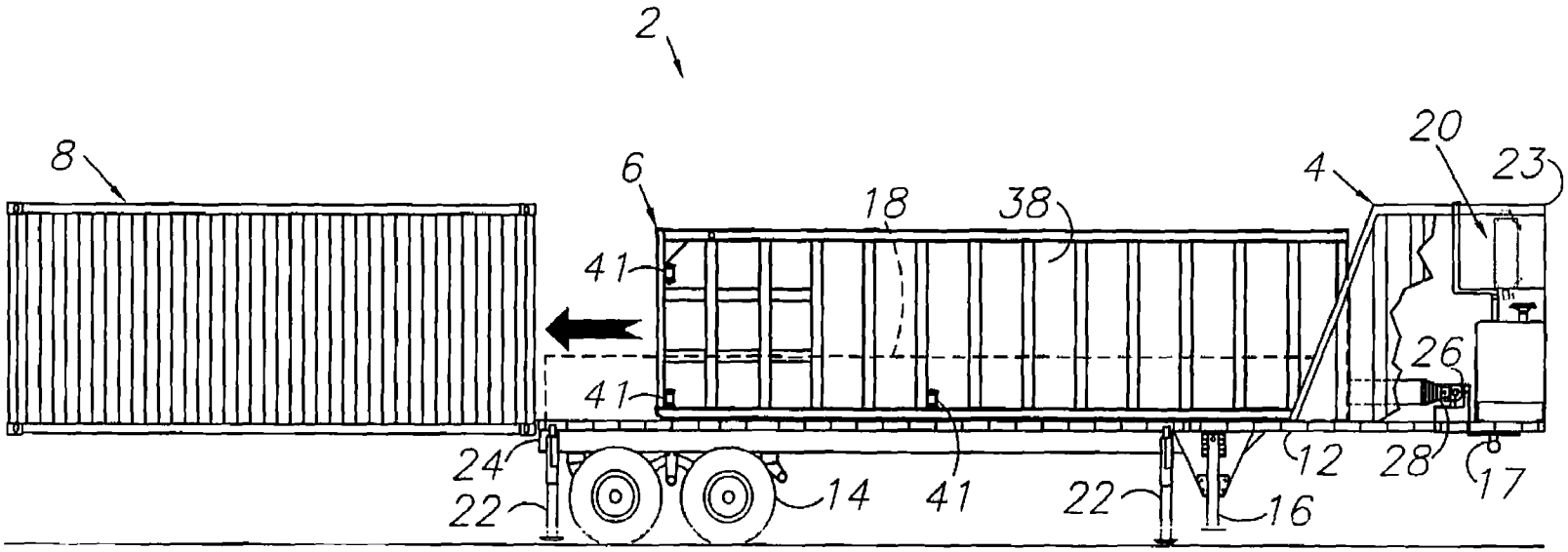
FIG. 1 is a side elevational view of a container packer system embodying an aspect of the present invention, shown with a container packer in a retracted position on a transfer base aligned with a transport container.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, up, base, front, back, right and left refer to the invention as oriented in the view being referred to. The words "inwardly" and "outwardly" refer to directions toward and away from, respectively, the geometric center of the embodiment being described and designated parts thereof. Forwardly and rearwardly are generally in reference to the direction of travel, if appropriate. Said terminology will include the words specifically mentioned, derivatives thereof and words of similar meaning.

Referring to the drawings in more detail, the reference numeral 2 generally designates a container packer system embodying an aspect of the present invention. The system 2 generally comprises a transfer base 4 reciprocally and slidably mounting a container packer 6. A transport container 8 receives bulk material 10 from the container packer 6.

II. Transfer Base 4

The transfer base 4 can comprise a vehicle, such as a trailer, as shown in FIG. 1. Alternatively, the transfer base 4 can be another type of vehicle or a permanent structure. The transfer base 4 can be generally constructed as a flatbed trailer with a bed 12 mounting a wheel truck 14, a pair of adjustable-height main jacks 16 and a king pin hitch 17 for connection to a tractor unit (not shown). A pair of sidewalls 18 is mounted on either side of the bed 12.

The transfer base 4 includes a power subsystem 20, which can include an internal combustion engine, an hydraulic pump, an hydraulic reservoir, an hydraulic control valve and other hydraulic components, equipment, lines and fittings as needed. Alternatively, other power sources can be utilized, such as pneumatic, electric, combination hydraulic-pneumatic-electric, etc. External power sources, e.g., electrical service, can be connected to the transfer base 4 for powering its operations.

A front cylinder mount 26 is located in proximity to the power subsystem 20, i.e. foreword on the transfer base 4, and mounts a proximate end 28 of a multi-stage insertion/extraction piston-and-cylinder unit 30, which also includes a distal end 32 connected to the container packer 6.

III. Container Packer 6

The container packer 6 includes: front and back ends 34, 36; opposite sidewalls 38, 40 mounting rollers 41 for engaging the transfer base sidewalls 18 and the transport container 8: and a floor 42 mounting rollers 43 on which the container packer 6 rolls fore-and-aft. A rolling, overhead door 44 is mounted generally in and selectively closes a back opening 35, which is formed in the back end 36 for selectively enclosing a container packer interior 46, which receives the bulk material 10. The door 44 is operated by a door piston-and-cylinder unit 48. Alternatively, various other types of doors and operating mechanisms can be utilized.

Figure 4:
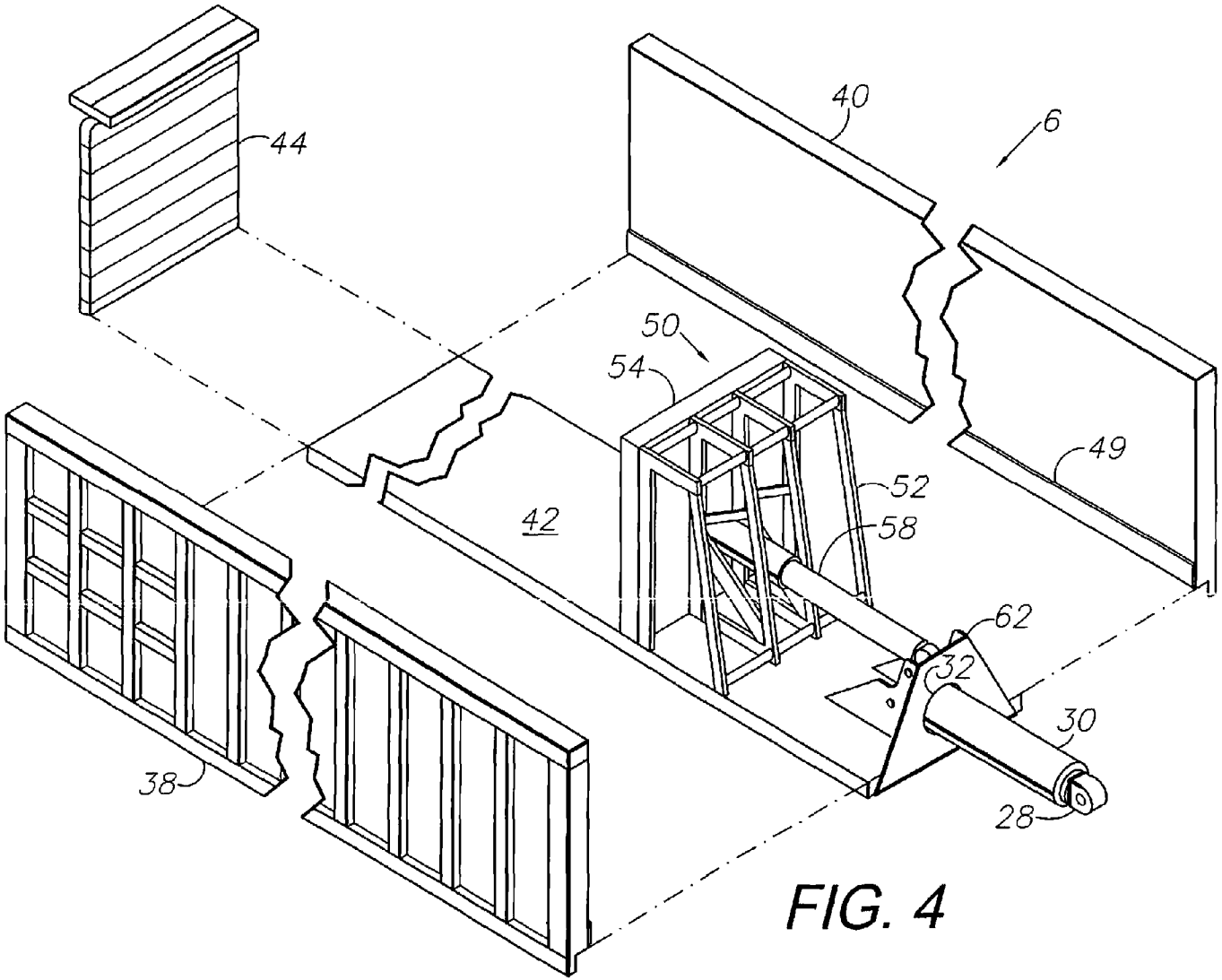
FIG. 4 is an exploded view of the container packer.
Figure 5:
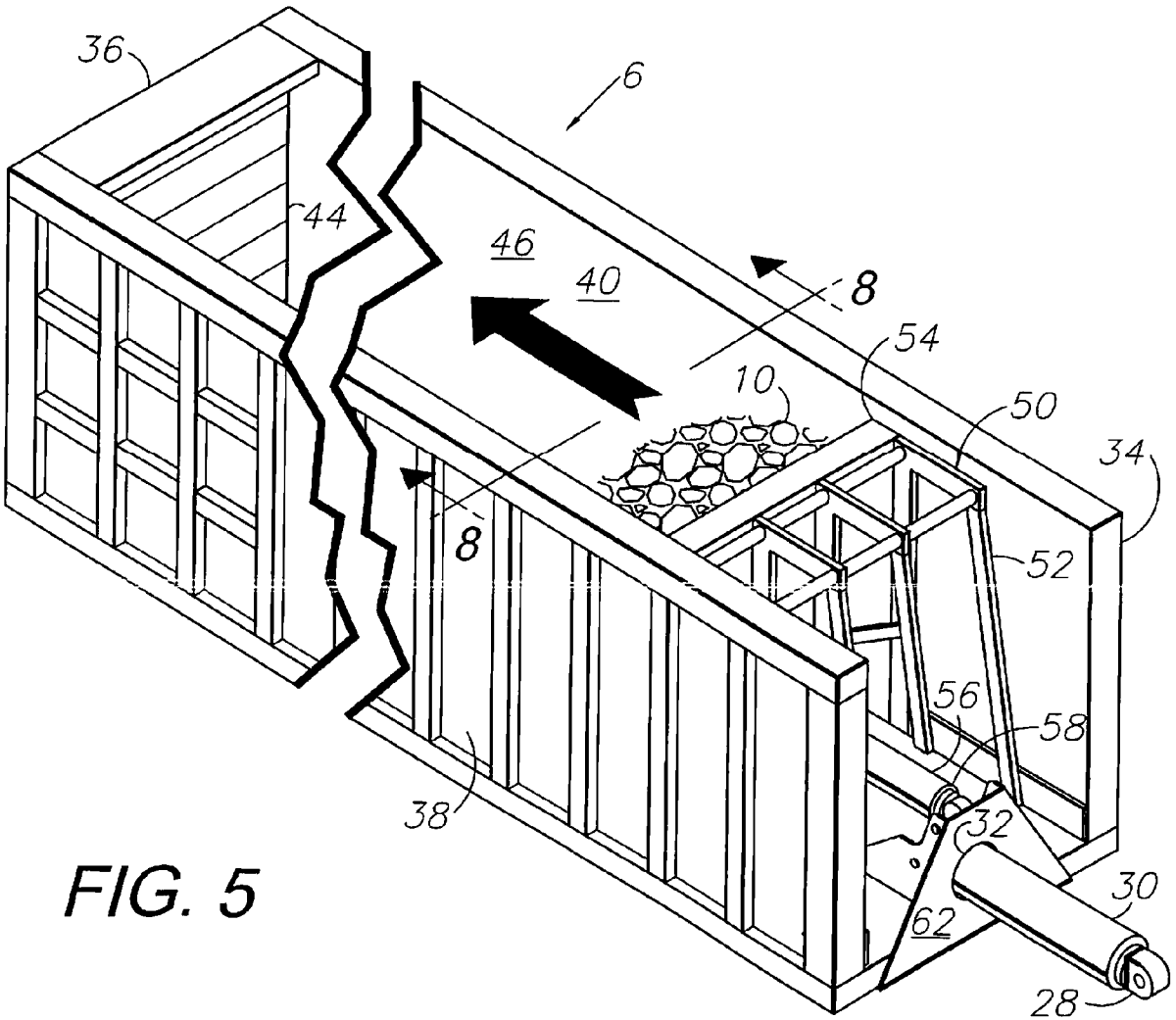
FIG. 5 is a fragmentary, upper, front perspective view of the container packer, with a blade assembly thereof in a retracted position.
Figure 6:
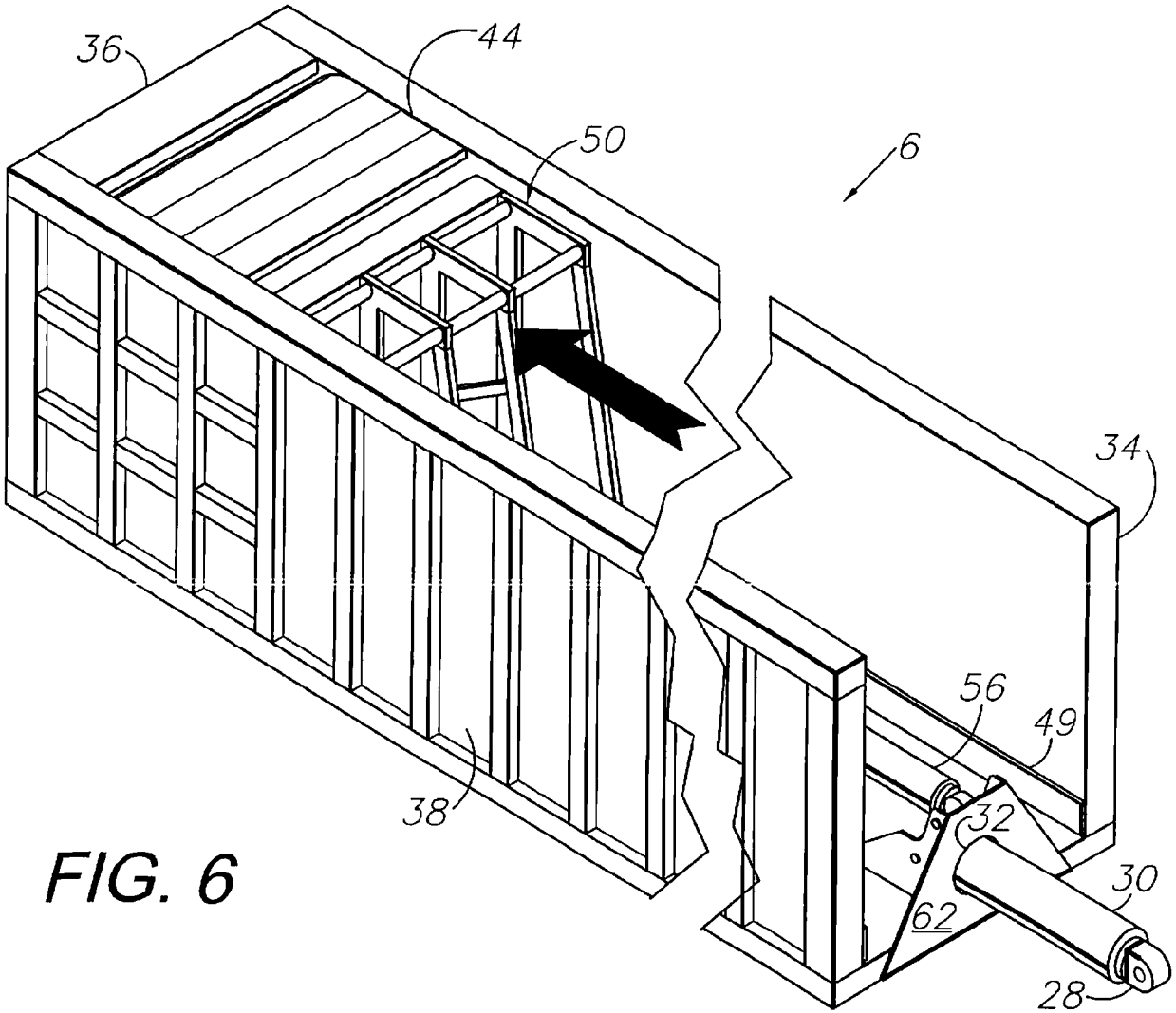
FIG. 6 a fragmentary, upper, front perspective view of the container packer, with the blade assembly thereof in an extended position.
Figure 7:
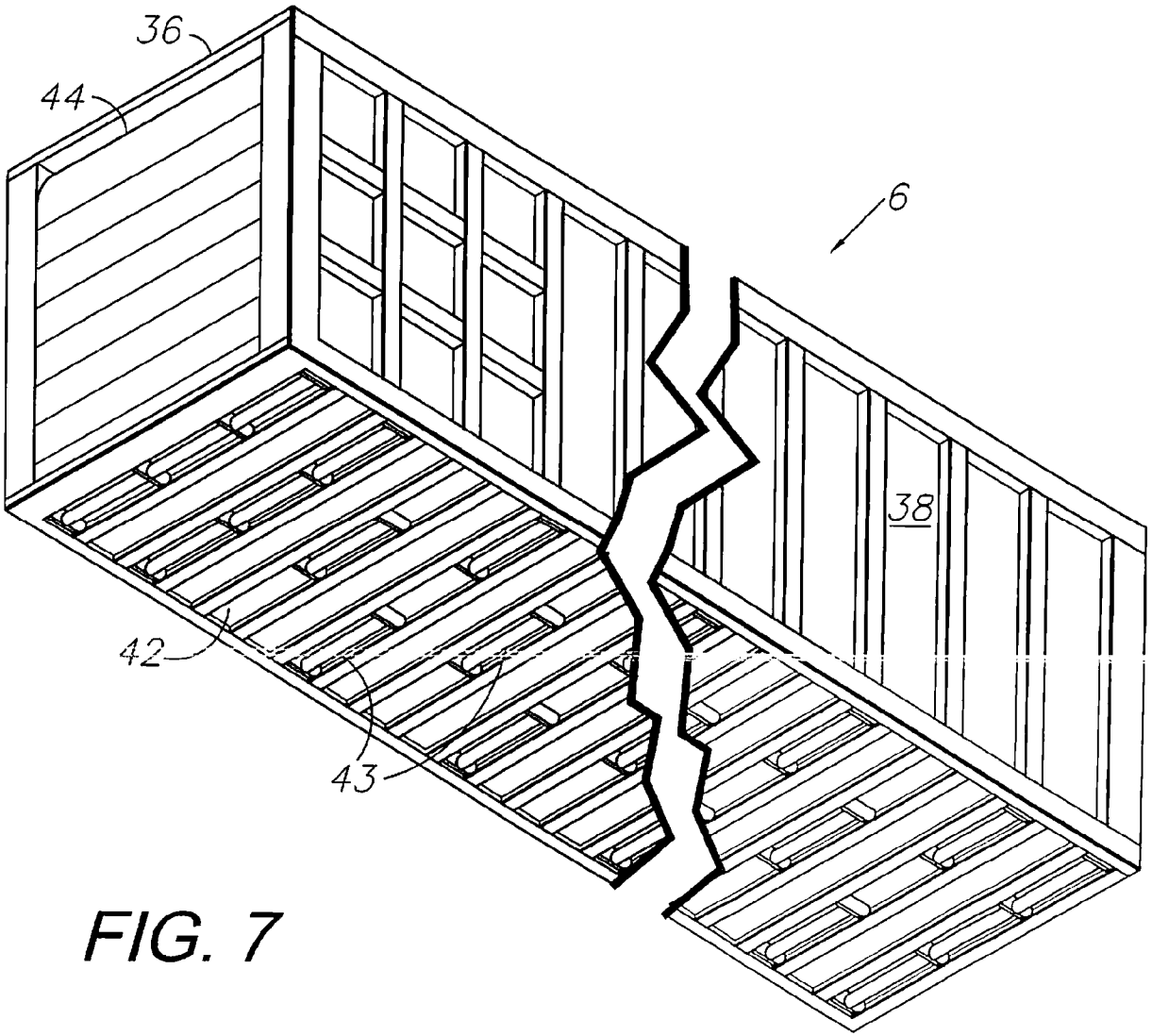
FIG. 7 is a fragmentary, lower, back perspective view of the container packer.
Figure 8:
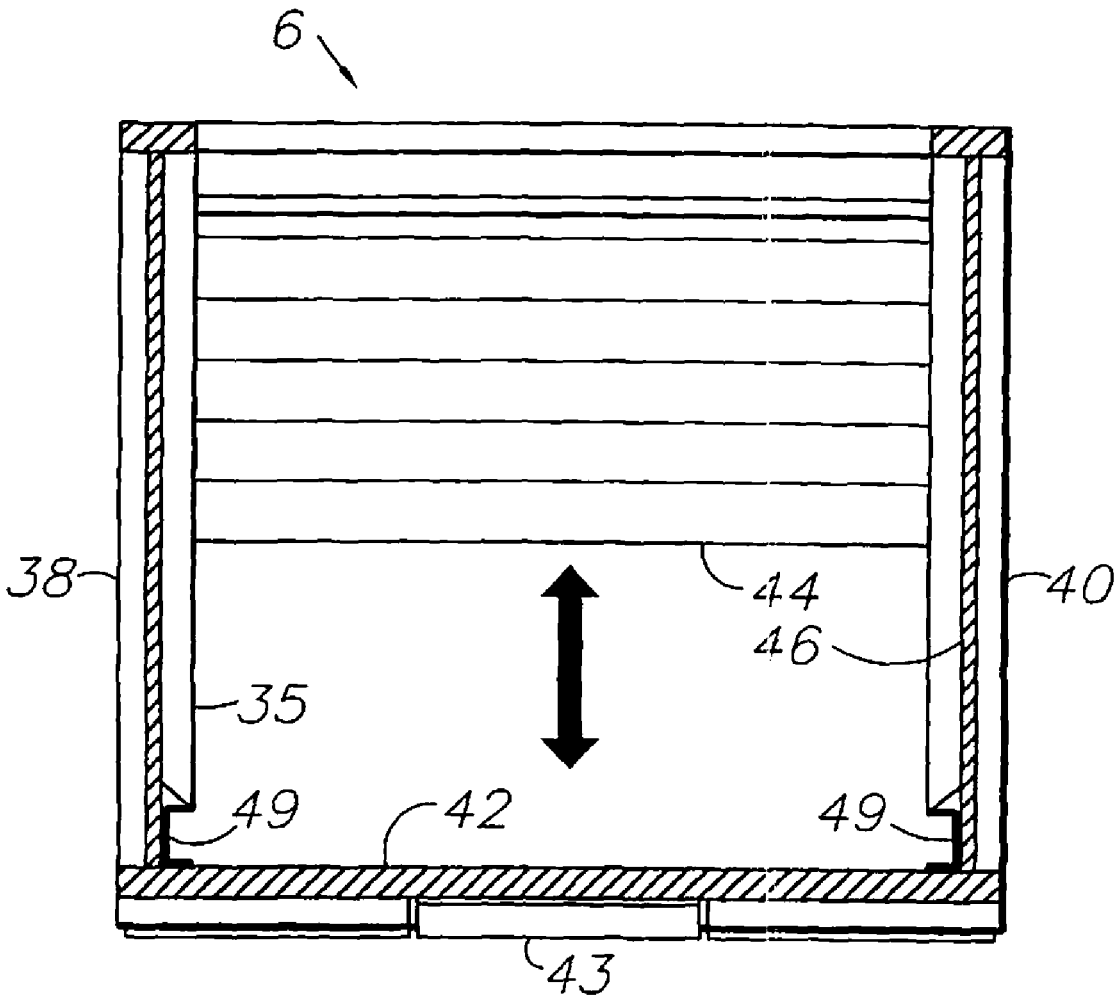
FIG. 8 is a vertical cross-sectional view of the container packer taken generally along line 8-8 in FIG. 5.

The container packer 6 includes a push blade assembly 50, which includes a structural framework 52 mounting a push blade 54, which fits relatively closely within the container packer interior 46 and extends transversely for movement fore-and-aft guided by tracks 49 formed in the container packer sidewalls 38, 40 whereby substantially all of the contents of the container packer 6 can be discharged through the back door opening 35. The push blade assembly 50 includes a framework 52 mounting a push blade 54 generally configured as a panel with width and height dimensions generally corresponding to a cross-section of the container packer interior 46. A push blade piston-and-cylinder 56 extends through the framework 52 and the blade 54, to which the piston-and-cylinder 56 is attached in a trunion-type mounting 57. The piston-and-cylinder unit 56 includes an extension 60, which extends distally of the blade 54 with the piston-and-cylinder 56 in a retracted position (FIG. 4). With this configuration a relatively long effective stroke of the piston-and-cylinder 56 is available for pushing the push blade assembly 50 through a substantial portion of the container packer 6. An anchor structure 62 is mounted on the container packer floor 42 adjacent to the container packer back end 36 and is connected to the piston-and-cylinder proximate end 58.

IV. Operation

In the practice of an aspect of the method of the present invention, the operation of the system 2 is sequenced to transfer bulk material 10 from the container packer 6 to the transport container 8. The container 8 is positioned in alignment with the transfer base 4. For example, the container 8 may be placed on a trailer or truck bed for transport. The hydraulic leveling jacks 22 are adapted for independent adjustment to align the transfer base 4 with the container 8. An automated positioning system can be utilized to automatically adjust the transfer base 4 for optimal alignment.

Figure 2:
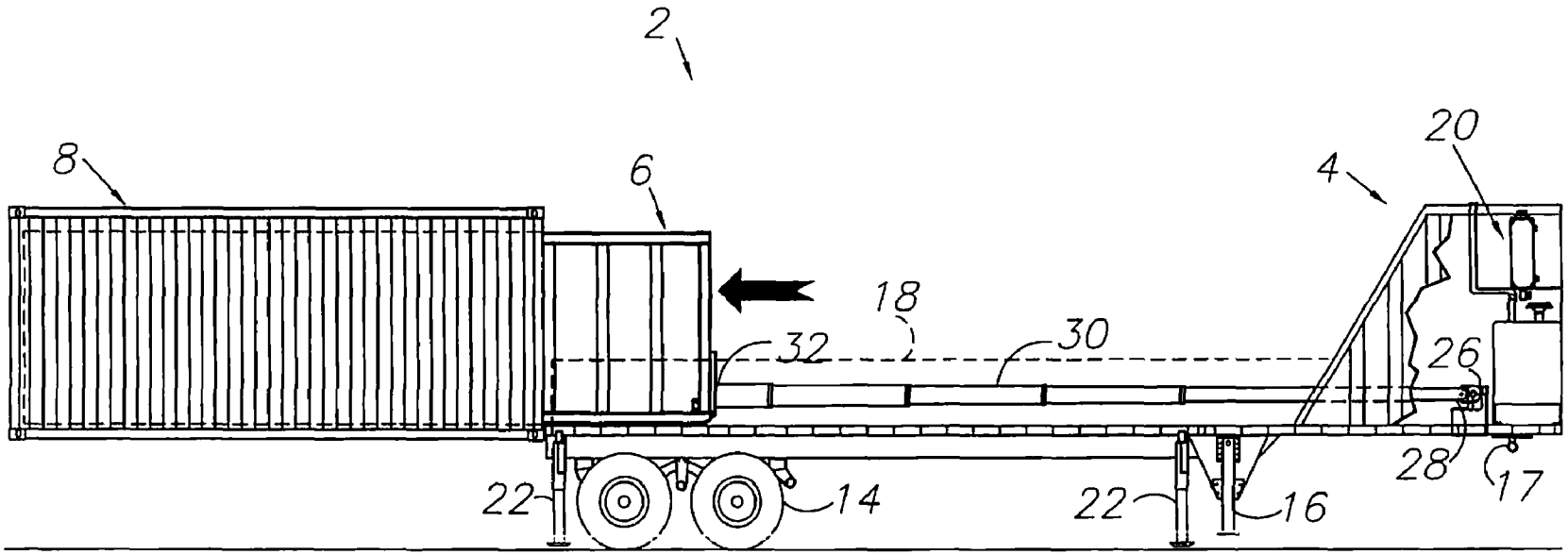
FIG. 2 is a side elevational view thereof, shown with the container packer extended partly into the transport container.
Figure 3:
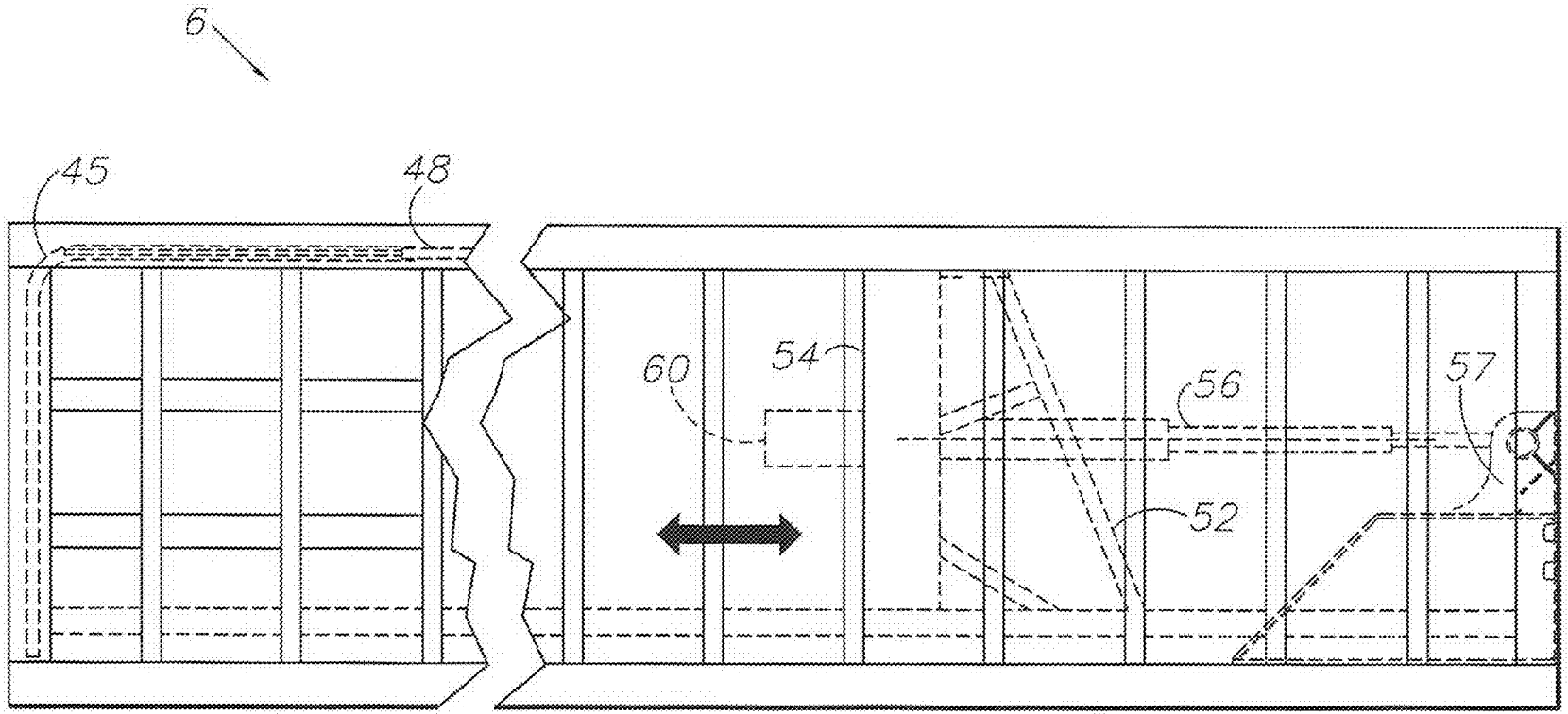
FIG. 3 is an enlarged, fragmentary, side elevational view of the container packer.

With the transfer base 4 and the container properly aligned, the container packer 6 starts from a retracted position (FIG. 1) and is pushed rearwardly by the transfer base piston and cylinder unit 30 to an extended position (FIG. 2). The container packer door 44 is raised hydraulically via the piston-and-cylinder units 48, thus opening the back opening 35 for discharge of the bulk material 10. Applying hydraulic power to the piston-and-cylinder unit 56 extends it and pushes the push blade assembly 50 rearwardly through the container packer interior 48. The blade 54 pushes the bulk material 10 through the back opening 35 and out of the container packer 6 and into the transport container 8. Depending upon the nature of the bulk material 10, it may be compacted by the push blade assembly 50 in the transport container 8. Simultaneously with discharging the contents 10 of the container packer 6, the hydraulic system can open the hydraulic lines to the transfer base piston-and-cylinder unit 30, allowing it to retract as the contents are pushed out of the container packer interior 46. The transfer base piston-and-cylinder unit 30 can also be powered to hydraulically extract the container packer 6 by collapsing to its retracted position (FIG. 1). Upon full extraction of the container packer 6, the transport container 8 can be closed and removed for transport.

It will be appreciated that various steps of the procedure described above, and additional steps, can be automated with a programmable microprocessor. For example, leveling the transfer base 4, inserting the container packer 6 and operating the push blade assembly 50 can all be automated. Moreover, hydraulic controls utilizing a multi-position valve(s) can be provided for an operator to control the functions of the system 2. Such a valve(s) can also be automated.

It is to be understood that while certain embodiments and/or aspects of the invention have been shown and described, the invention is not limited thereto and encompasses various other embodiments and aspects.

Having thus descried the invention, what is claimed as new and desired to be Secured by letters Patent is:

1. A system for packing bulk material in a container, which system comprises:

a transfer base including proximate and distal ends and a container packer guide, said transfer base including a floor, and said container packer guide comprising said transfer base floor;

a container packer including a proximate end, a distal end with an opening, opposite sidewalls, a floor, an interior, and rollers mounted on said container packer floor adapted for rolling over said transfer base floor;

said container packer being movable longitudinally along said container packer guide between a retracted position on said transfer base and an extended position extending at least partially from said transfer base distal end;

said container packer having a pair of door tracks each extending along a respective side of said door opening and along a respective container packer sidewall;

a door being movably mounted on said tracks;

a pair of container packer door piston-and-cylinder units each connected to a respective container packer sidewall and to said container packer door;

said container packer door piston-and-cylinder units operably moving said door between its open and closed positions;

a container packer drive connected to said transfer base and said container packer and adapted for moving said container packer between its extended and retracted positions;

a material transfer assembly mounted in said container packer interior and adapted for discharging bulk material through said container packer distal end opening;

a material transfer assembly drive connected to said material transfer assembly and adapted for operating said material transfer assembly;

said material transfer assembly comprising a push blade assembly located in and affixed to said container packer and movable longitudinally between a retracted position in proximity to said container packer proximate end and an extended position in proximity to said container packer distal end;

said push blade assembly including a push blade extending transversely across said container packer interior, and adapted for compressing bulk material in said transport container;

said container packer drive comprising a container packer piston-and-cylinder unit connected to said transfer base proximate end and said container packer proximate end;

an hydraulic power source mounted on said transfer base and connected to said container packer piston-and-cylinder unit;

said material transfer assembly drive comprising a push blade assembly piston-and-cylinder unit connected to said hydraulic power source and adapted for extending and retracting said push blade assembly between an extended position distally beyond said transfer base distal end and a retracted position adjacent to said container packer proximate end within said container packer interior, said push blade assembly movement sequentially cooperating with said container packer movement whereby said push blade assembly is adapted for compacting bulk material in said container;

wherein said container packer drive piston-and-cylinder unit is attached at a position relative to the base of said container packer, and said push blade assembly piston-and-cylinder unit is attached at the approximate center of said push blade assembly;

said material transfer assembly, including said material transfer assembly drive and push blade assembly, being adapted for sequentially filling said transport container with multiple container packer loads against said transport container distal end;

a transport container selectively locatable in proximity to said transfer base distal end and adapted for selectively receiving at least a portion of said container packer with said container packer in its extended position;

wherein said push blade is of substantially equal height and width as the internal dimensions of the container packer so that as the material transfer assembly can move and compact the entire volume of bulk material within said container packer assembly with one extension of said assembly piston-and-cylinder; and said push blade assembly further including a generally vertical blade mounted on said framework and extending generally transversely across said container packer interior.

2. The container packer system according to claim 1, which includes:

said container packer having a pair of guide rails each mounted on and extending horizontally along a respective sidewall inside said enclosure;

said push blade assembly including a framework with rollers rollingly engaging said guide rails; and said push blade assembly further including a generally vertical blade mounted on said framework and extending generally transversely across said container packer interior.

3. The container packer system according to claim 1, wherein said transport container comprises a standard shipping container.

4. The container packer system according to claim 1 wherein said transfer base comprises a trailer with a wheel truck connected to its floor.

5. The container packer system according to claim 1 wherein:

said container packer includes a door mounted in said distal end opening; and said door being movable between open and closed positions respectively opening and closing said container packer distal end opening.

* * * * *

UNITED STATES PATENT AND TRADEMARK OFFICE

CERTIFICATE OF CORRECTION

PATENT NO. : 7,744,330 B2
APPLICATION NO. : 12/138973
DATED : June 29, 2010
INVENTOR(S) : Gregory D. Haub and Chris D. Bartel It is certified that error appears in the above-identified patent and that said Letters Patent is hereby corrected as shown below:

Column 3, Line 22 strike out "A front cylinder mount 26" and insert instead --A container packer drive including a front cylinder mount 26--

Column 3, Line 39 strike out "The container packer 6 includes a push blade assembly 50," and insert instead --The container packer 6 includes a material transfer assembly, an embodiment of which includes a pushblade assembly 50,--

Figure 9:
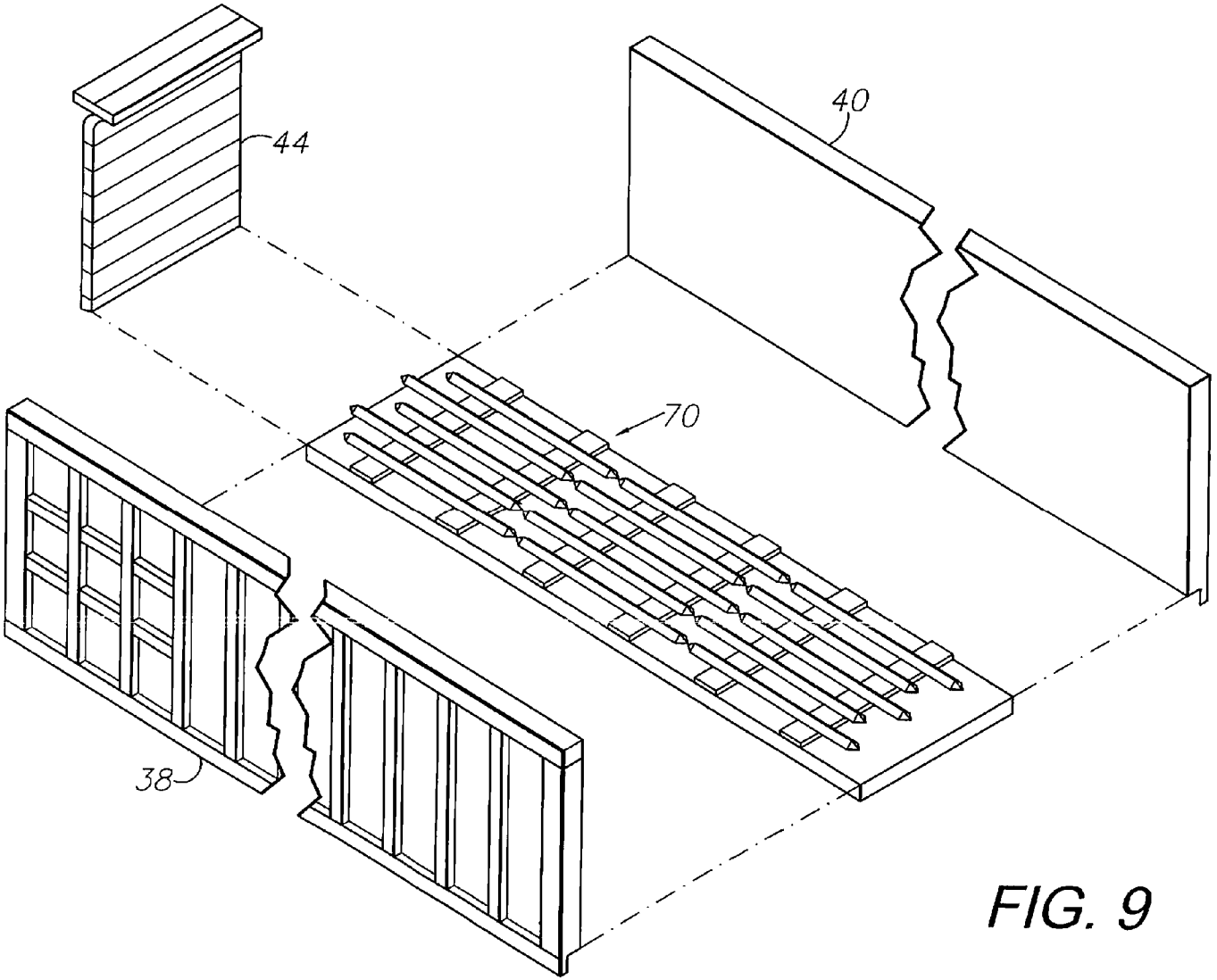
FIG. 9 is an exploded view of a container packer comprising an alternative aspect of the present invention, shown with a moving floor.
Figure 10:
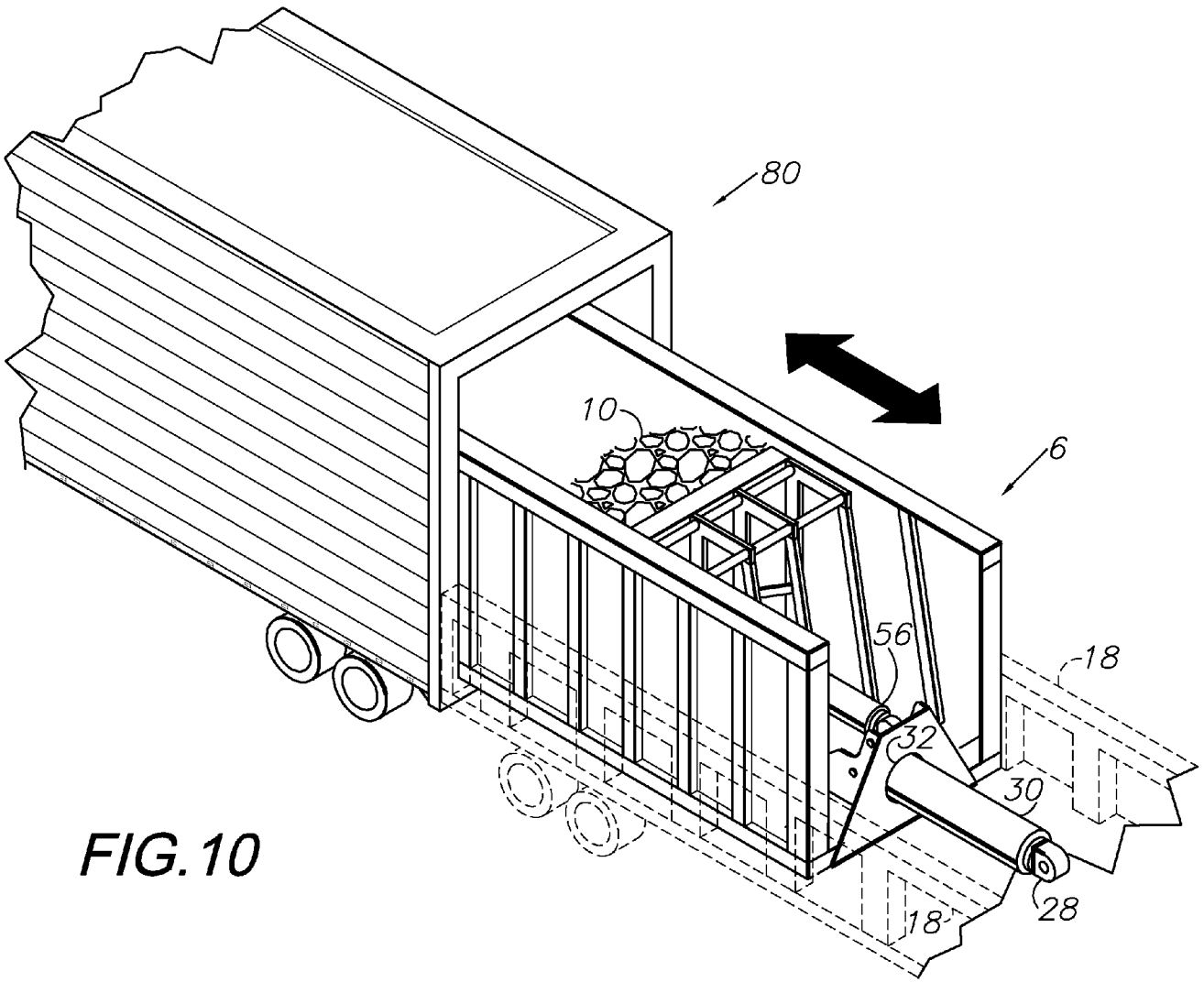
FIG. 10 is a fragmentary, upper perspective view of a container packer system comprising an alternative aspect of the present invention, shown with the container packer extending partly into a trailer.

Column 3, Line 61 insert --Fig. 9 shows an alternative embodiment wherein a moving floor 70 is used to eject material from the container packer in place of the push blade assembly 50. The moving floor is essentially a series of moving, powered slats that operate to move material out of a contained space. This may be a preferable method of unloading the container packer when compaction of the material to be unloaded is not desirable.--

Signed and Sealed this

Thirty-first Day of August, 2010

David J. Kappos

David J. Kappos
*Director of the United States Patent and Trademark Office*